US006285283B1

(12) United States Patent
Rand et al.

(10) Patent No.: US 6,285,283 B1
(45) Date of Patent: Sep. 4, 2001

(54) SECURITY ANCHORING AND ELECTRONIC SENSOR SYSTEM

(75) Inventors: Richard Rand, East Northport; Joseph Deconinck, West Babylon, both of NY (US)

(73) Assignee: Protex International Corp., Bohemia, NY (US)

( * ) Notice: Subject to any disclaimer, the term of this patent is extended or adjusted under 35 U.S.C. 154(b) by 0 days.

(21) Appl. No.: 09/378,040

(22) Filed: Aug. 20, 1999

(51) Int. Cl.[7] ..... G08B 13/12; G08B 13/14

(52) U.S. Cl. ..... 340/568.2; 340/568.4; 340/572.8

(58) Field of Search ..... 340/568.2, 568.4, 340/572.8, 693.9; 439/917

(56) References Cited

U.S. PATENT DOCUMENTS 5,172,098 * 12/1992 Leyden et al. ..... 340/568
5,341,124 * 8/1994 Leyden et al. ..... 340/568
5,543,782 * 8/1996 Rothbaum et al. ..... 340/568
5,565,848 * 10/1996 Leyden et al. ..... 340/572
5,699,591 12/1997 Kane .
5,726,627 3/1998 Kane .
5,995,003 * 11/1999 Rogers ..... 340/568.4

* cited by examiner

*Primary Examiner*—John Tweel
(74) *Attorney, Agent, or Firm*—Collard & Roe, P.C.

(57) ABSTRACT

A security anchoring system comprising a security anchor having an aperture therethrough and a plurality of flexible wings extending outward. There is an adhesive layer attached to the bottom surface of the anchor for adhering the anchor to the article. A security wire is threaded through the aperture in the anchor and is held securely within the aperture of the anchor. A diode is connected to an end of the security wire threaded through the aperture. A switch is located the end of the security wire near the diode. The switch is closed when the anchor is adhered to the article. The switch is opened when the anchor is removed from the article. There is a security monitoring system connected to an end of the wire not threaded through the aperture, which sounds an alarm when the switch is opened. The alarm will sound if a thief attempts to steal the article either by cutting the wire or by prying off the anchor.

11 Claims, 6 Drawing Sheets

SECURITY ANCHORING AND ELECTRONIC SENSOR SYSTEM

BACKGROUND OF THE INVENTION

1. Field of the Invention

This invention relates to a security anchoring and electronic sensor system that readily adapts to curved surfaces of an article. In particular, the invention relates to such a security anchoring and electronic sensor system that is connected to an electronic alarm system for monitoring theft and vandalism of the article.

2. The Prior Art

It is known to attach an anchor to an article to be protected against theft by adhering the anchor to the article and attaching one end of a cable or cord to the anchor. The other end of the cable or cord is attached to a fixed support so that the article can only be moved a limited distance from the fixed support. The anchor is usually plastic and has an adhesive backing layer to attach the anchor to the article. The adhesive is strong enough so that a thief cannot readily peel the anchor from the article to detach the cable from the article. If the anchor cannot be readily peeled away from the article within 30–60 seconds, then this deters most thieves from trying to remove the anchor and steal the article.

Many prior art security anchors only work well on flat surfaces of an article, because the anchor is rigid and stays in one plane parallel to the surface of the article. If the article has a curved surface, the anchor can be pulled off with much less force. In addition, the non-resilient nature of the anchor urges the anchor to remain in its normal flat condition. Since the anchor cannot be flexed to adapt to curved surfaces, the nonresilient forces keep portions of the anchor away form the curved surface.

A solution to this problem has been proposed by U.S. Pat. No. 5,699,591 to Kane. This patent shows a security anchor that is adapted to adhere to curved surfaces without the anchor being peeled away. While this anchor solves the problem of attachment to curved surfaces, it suffers from the drawback of all of the prior art anchors in that the article can still be easily stolen if the thief cuts the cable attached to the anchor.

Another solution has been proposed by Product Theft Deterrent, which markets a sensor having a ribbed, flexible anchoring member connected to a diode and a switch. When the anchor is tampered with, the switch is triggered, which activates the diode and sends out an alarm. This device prevents tampering on some devices, but the one-way ribbed structure of the anchor prevents its use on irregular or spherical surfaces.

SUMMARY OF THE INVENTION

It is therefore an object of the present invention to provide a security anchoring system that can be adhered to both flat and curved surfaces.

It is another object of the present invention to provide a security anchoring system that sounds an alarm if any part of the anchor or cord is tampered with.

It is another object of the present invention to provide a security anchoring system that is simple to manufacture and install.

These and other objects of the invention are accomplished by a security anchoring system comprising a security anchor having an aperture therethrough, and an adhesive layer attached to the bottom surface of the anchor for adhering the anchor to the article. A security wire is threaded through the aperture in the anchor and is held securely within the aperture. A presence detection diode is connected to an end of the security wire threaded through the aperture. A switch is located at the end of the security wire near the diode. The switch is closed when the anchor is adhered to the article. The switch opened when the anchor is removed from the article. There is a security monitoring system connected to an end of the wire not threaded through the aperture, which sounds an alarm when the switch is opened or if the wire is cut. This way, the alarm will sound if a thief attempts to steal the article either by cutting the wire or by prying off the anchor.

The security monitoring system can be any type of system that accomplishes this purpose, such as that disclosed in U.S. Pat. No. 5,821,857 to Rand, the disclosure of which is herein incorporated by reference.

The anchor preferably comprises a plurality of flexible wings surrounding the aperture. Each wing is separated by a wing slot. One wing slot communicates with the aperture. There is a hinge area for each wing located between the adjacent pair of wing slots to allow one wing to flex independently of another wing.

The wire is optionally coated with a flexible sheath made of an elastomeric material.

The wire is preferably maintained in the aperture by an assembly comprising an upwardly extending wall surrounding the aperture on the anchor and having a slit along one side. The slit extends out to the edge of the anchor to allow the wire to be inserted in the aperture through the slit. There is an enclosure surrounding the switch and diode. The enclosure has a lower portion extending through the aperture and disposed within the wall, and an upper bifurcated portion extending beyond the wall. A retainer cone surrounds the wire, above the wall. The retainer cone has an internal circumference slightly smaller than the circumference of the bifurcated portion of the enclosure, so that sliding the retainer cone over the enclosure squeezes the enclosure inward and holds the wire within the anchor. The lower portion of the enclosure has a longitudinally extending protrusion that fits within the slit in the wall to fill in the gap created by the slit and give added mechanical rigidity.

The aperture, enclosure and wall are preferably hexagonal in shape. This shape is ideal for providing six wings on the anchor, which is an optimal amount for adhering the anchor to a curved article. In addition, the hexagonal shape also prevents rotational movement of the elements within the wall of the anchor.

The adhesive preferably has an aperture extending therethrough, which is smaller than the aperture of the anchor. There is a ring-shaped ledge mounted on a bottom end of the enclosure, that extends partially into the aperture in the adhesive. The purpose of the ledge is to provide an additional deterrent to a thief. Sliding a knife between the anchor and the adhesive will not release the anchor from the article, because the knife will abut the ring-shaped ledge and prevent further insertion of the knife.

The switch is preferably a detector switch that is activated by a plunger located on its bottom surface. Adhering the anchor to an article depresses the plunger, and removing the anchor from the article releases the plunger, thus triggering the alarm. Cutting the wire also triggers the alarm.

There is preferably a bi-color LED connected to the system to indicate the status of the anchor. This LED is preferably located on the enclosure and lights up green if the switch is closed and red if the switch is opened.

In an alternative embodiment, the wire is connected to the enclosure by a connecting system similar to a telephone jack. The female portion of the jack is mounted on the enclosure and is electronically connected to the diode and switch. The security wire is then connected to a male portion of the jack, which then snaps into the female portion to connect the wire to the switch and diode.

With this embodiment, the anchor is hinged on one side and has a locking clasp on the other side to allow the anchor to be mounted around the enclosure. The anchor locks closed after it is mounted, and cannot be re-opened.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
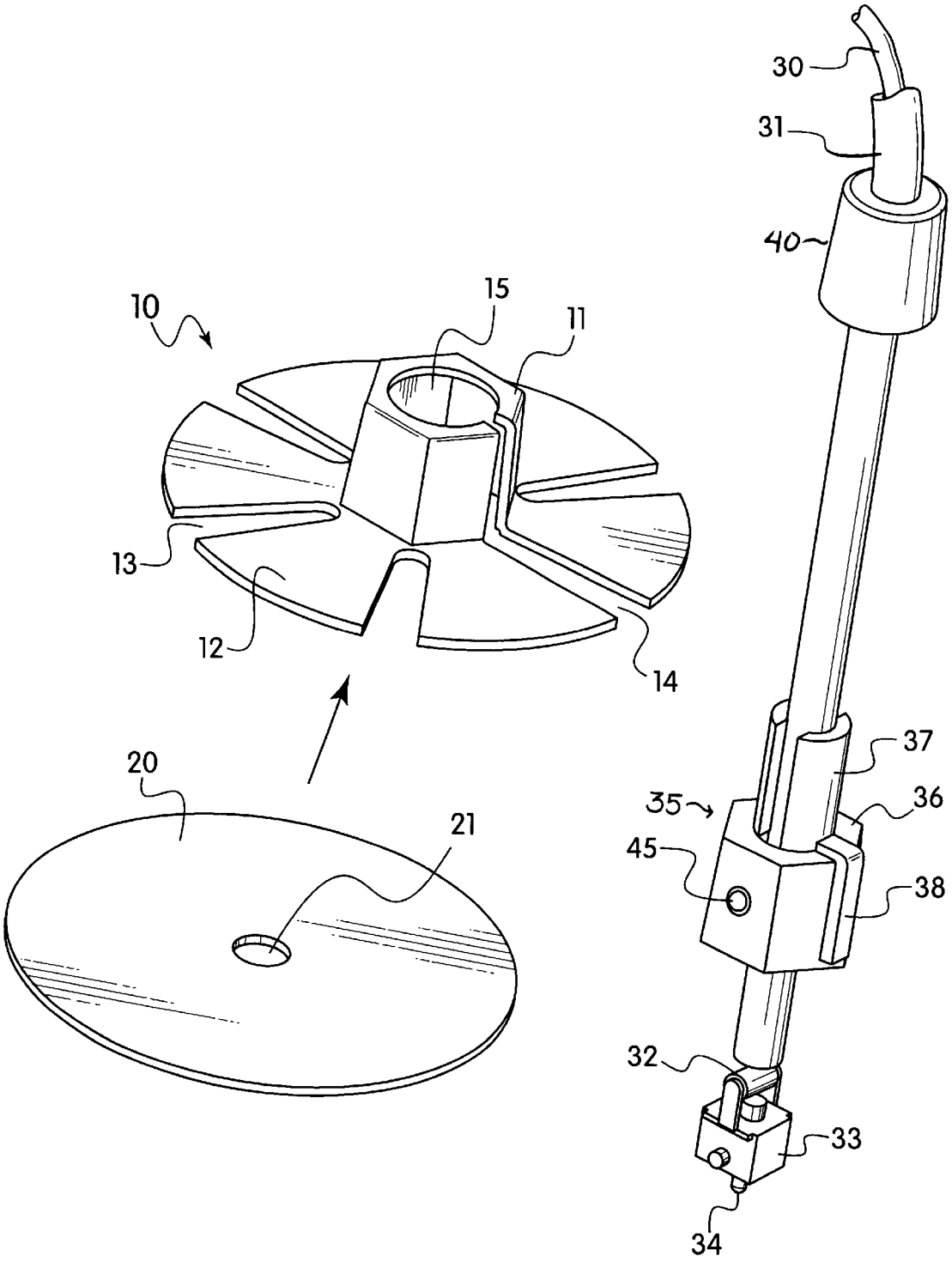
FIG. 1 shows an exploded view looking from the top of the security anchoring system according to the invention.
Figure 2:
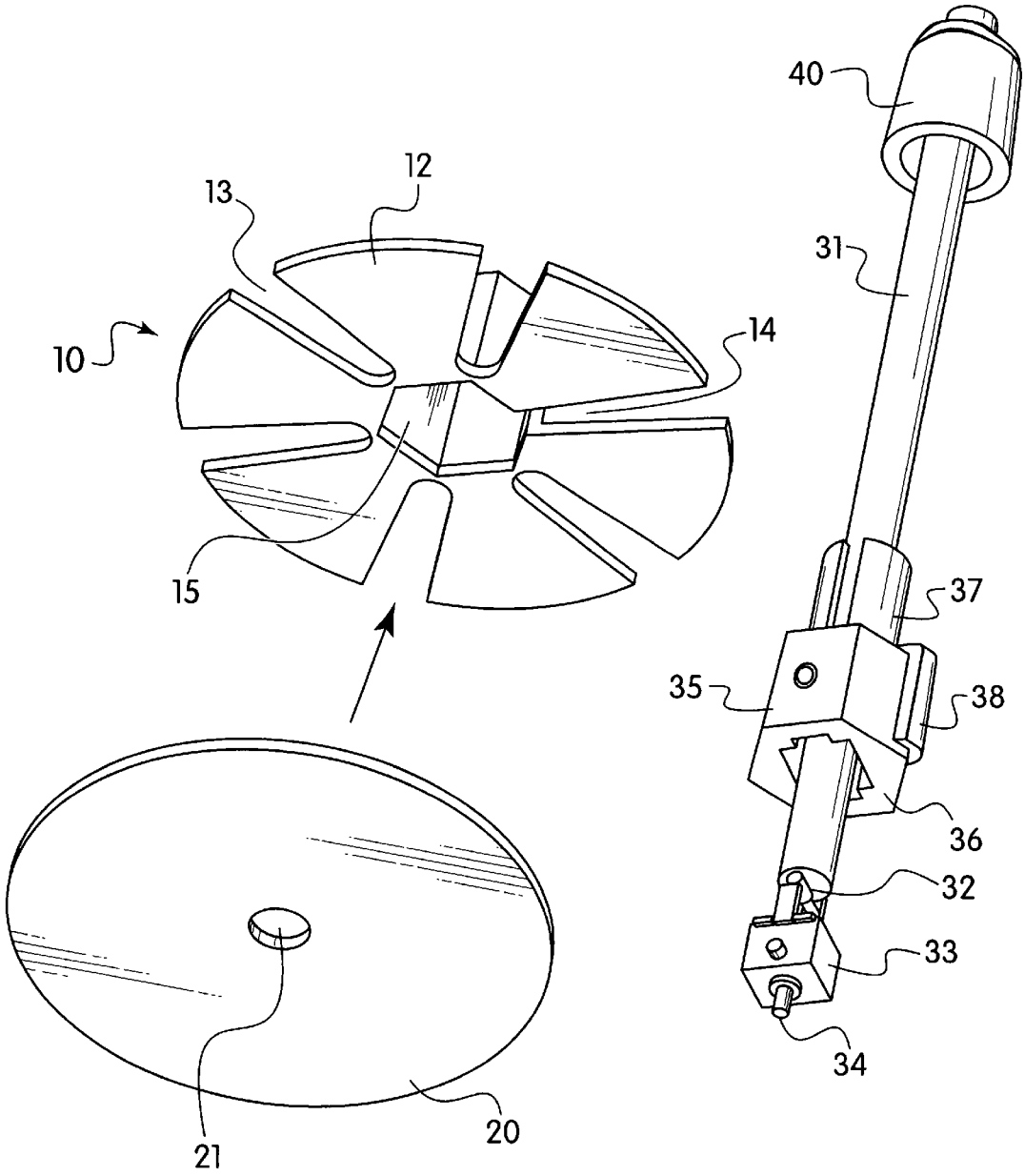
FIG. 2 shows an exploded view looking from the bottom of the security anchoring system according to the invention.
Figure 3:
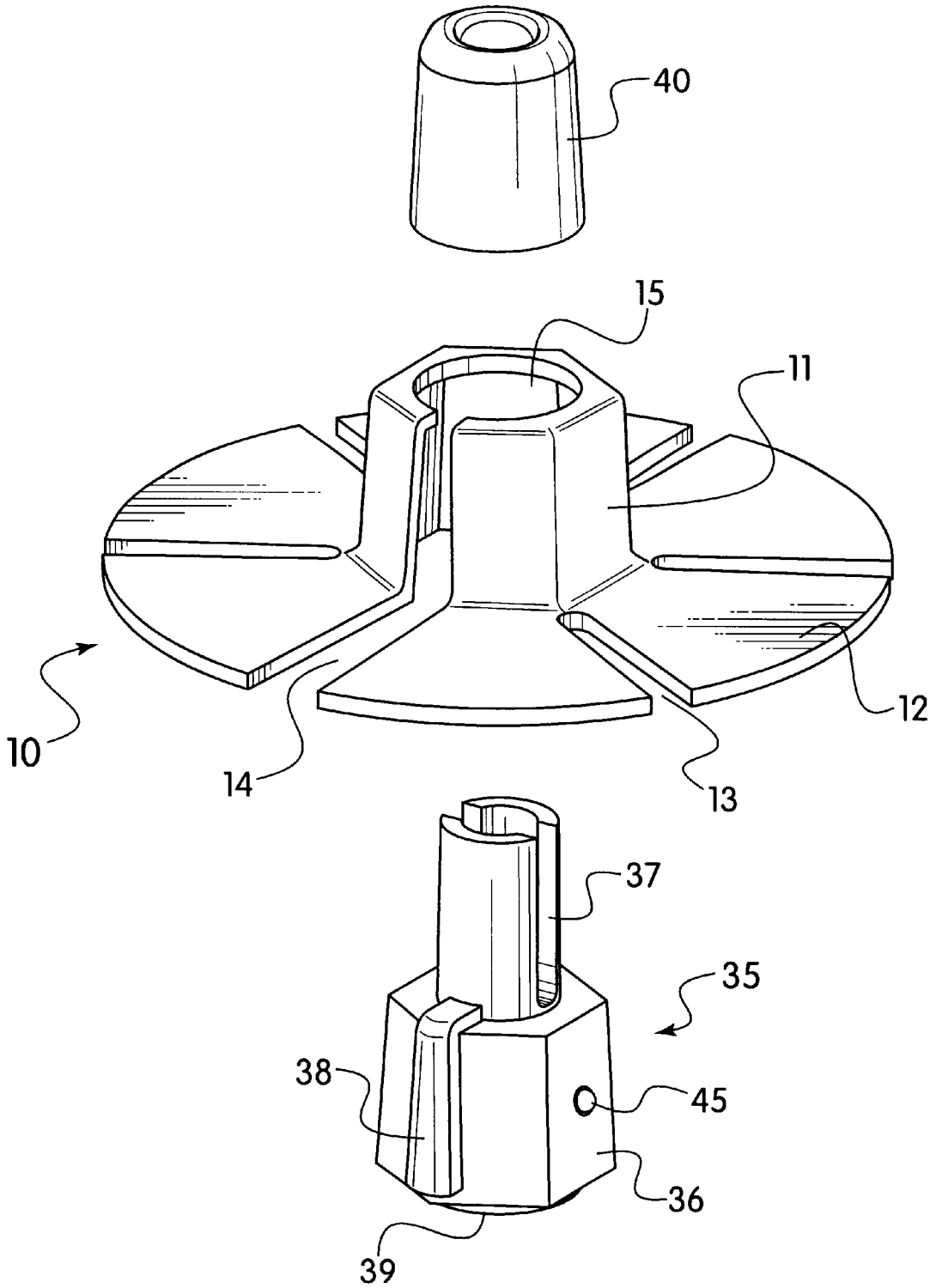
FIG. 3 shows an enlarged exploded view of the means for keeping the wire in place according to the invention.

Referring now in detail to the drawings and, in particular, FIGS. 1 and 2, there are shown two exploded views of the security anchoring system according to the invention. The system comprises an anchor 10, which consists of a wall portion 11 and a plurality of wings 12 separated by wing slots 13. There is a slit 14 extending into the wall portion 11 to provide a way to insert a wire therein. Wall portion 11 has an aperture 15 extending therethrough.

An adhesive pad 20 is affixed to the bottom of anchor 10. Adhesive pad 20 has double-sided adhesive so that it adheres to both anchor 10 and the surface of an article (not shown). Adhesive pad 20 has an aperture 21 therethrough. Aperture 21 is larger than aperture 15 of anchor 10.

A security wire 30 encased in an elastomeric coating 31 is inserted through slit 14 to extend through aperture 15. The end of wire 30 is connected to a diode 32 and to a switch 33. Switch 33 has a plunger 34 located on the bottom to trip the switch when pressure is applied to plunger 34. Wire 30 is retained in place. within aperture 15 by an enclosure 35, which consists of a hexagonal lower portion 36 and a bifurcated upper portion 37. Hexagonal lower portion 36 fits snugly within wall portion 11 of anchor 10 and keeps the end of wire 30 with switch 33 from pulling out of anchor 10. The inner surface of lower portion 36 conforms to the shape of diode 32 and switch 33 so that these elements are firmly retained within enclosure 35. Lower portion 36 has a longitudinal protrusion 38 that fits within slot 14.

A bi-color LED 45 is connected to wire 30 and is arranged on enclosure 35. LED 45 indicates the status of the anchoring system. LED glows green when switch 33 is closed and active, and glows red when switch 33 is opened, indicating an alarm situation.

Figure 4:
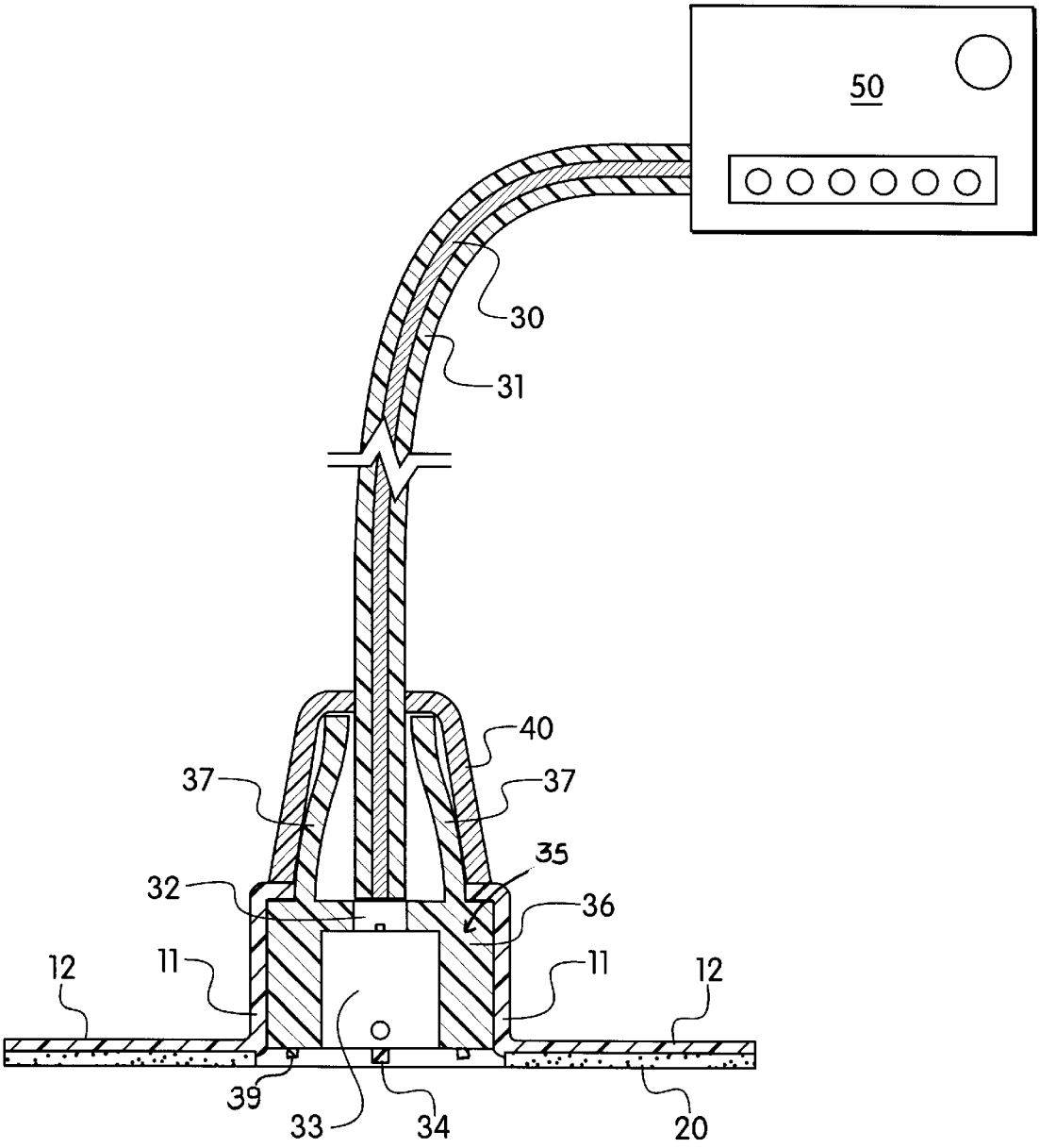
FIG. 4 shows a cross-sectional view of the security anchoring system according to the invention.

A retainer cap 40 is slid down wire 30 and placed over bifurcated upper portion 37 to hold wire 30 in place. As shown in FIG. 4, retainer cap 40 squeezes bifurcated upper portion 37 inward to securely grip wire 30 in between. Cap 40 thus has an inner diameter that is smaller than the diameter of bifurcated upper portion 37.

Figure 5:
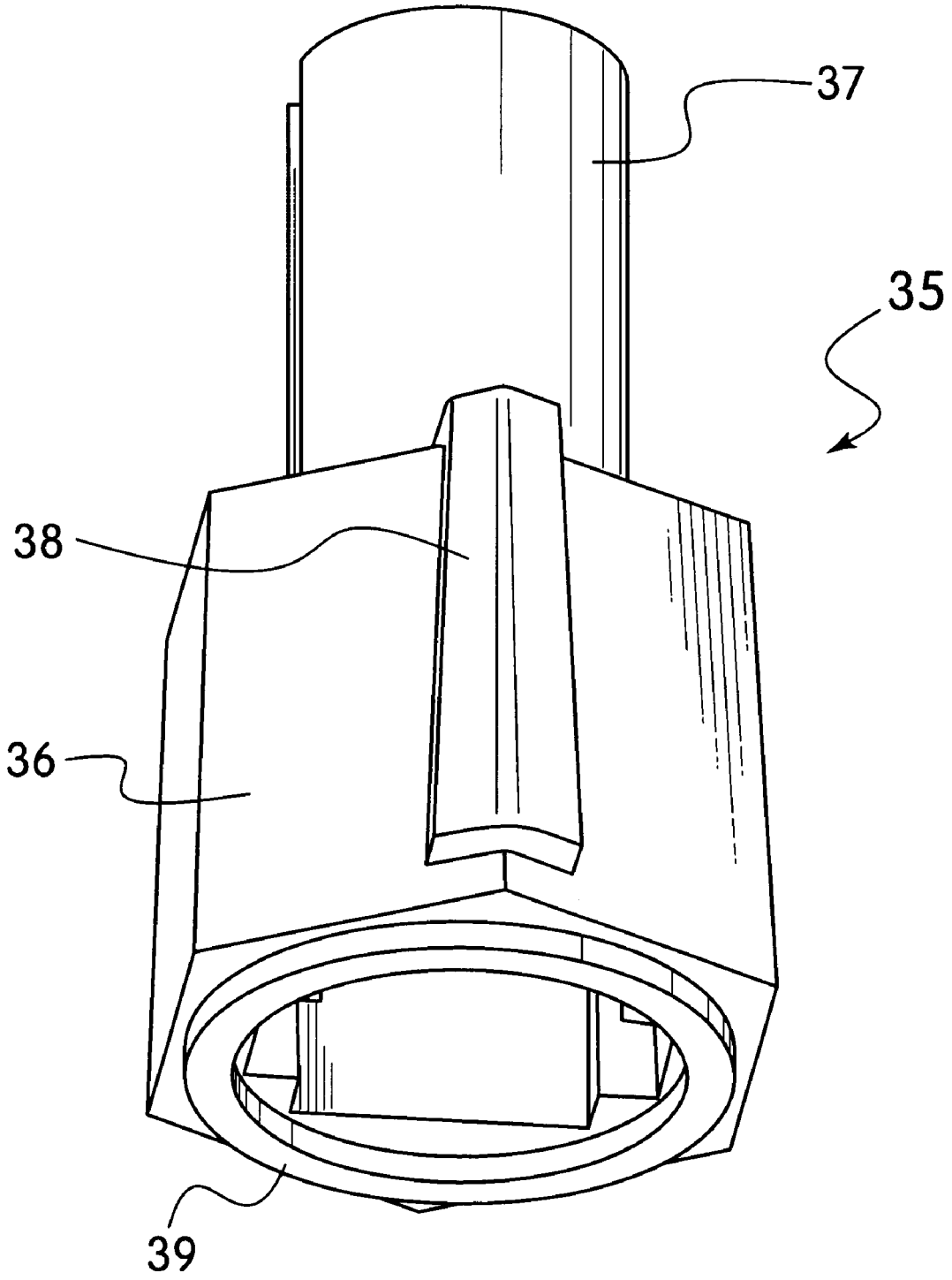
FIG. 5 shows a perspective view of the enclosure component of the security anchoring system according to the invention.

This arrangement keeps wire 30 with switch 33 and diode 32 securely retained within anchor 10. As shown in FIGS. 4 and 5, enclosure 35 has a protruding ring-shaped ledge 39 disposed on its bottom surface. Ledge 39 fits into aperture 21 of adhesive pad 20. As shown in FIG. 4, ledge 39 extends only partially into aperture 21, so as not to disrupt the seal between adhesive pad 20 and the article to be secured. Ledge 39 prevents a thief from prying enclosure 37 and thus anchor 10 away from adhesive pad 20 to steal the secured article. A knife inserted between enclosure 35 and adhesive pad 20 will be stopped by ledge 39 before it can be inserted sufficiently to remove anchor 10 from adhesive pad 20.

As shown in FIG. 4, wire 30 is connected to a central alarm control box 50, which sends an audible alarm throughout the premises if the anchoring system is tampered with. The system works as follows: After the system is assembled as shown in FIG. 4, it is mounted to an article to be secured. Pressing anchor 10 onto the article causes plunger 34 to be depressed, thus causing switch 33 to close.

Central alarm control box 50 is programmed to send an audible alarm at any time that switch 33 is opened, which opens the circuit to the central alarm control box. This will happen if wire 30 is cut, or if anchor 10 is removed from the article, thus releasing plunger 34. Several security anchoring systems may be connected to a single control box 50, which can monitor multiple articles.

Figure 6:
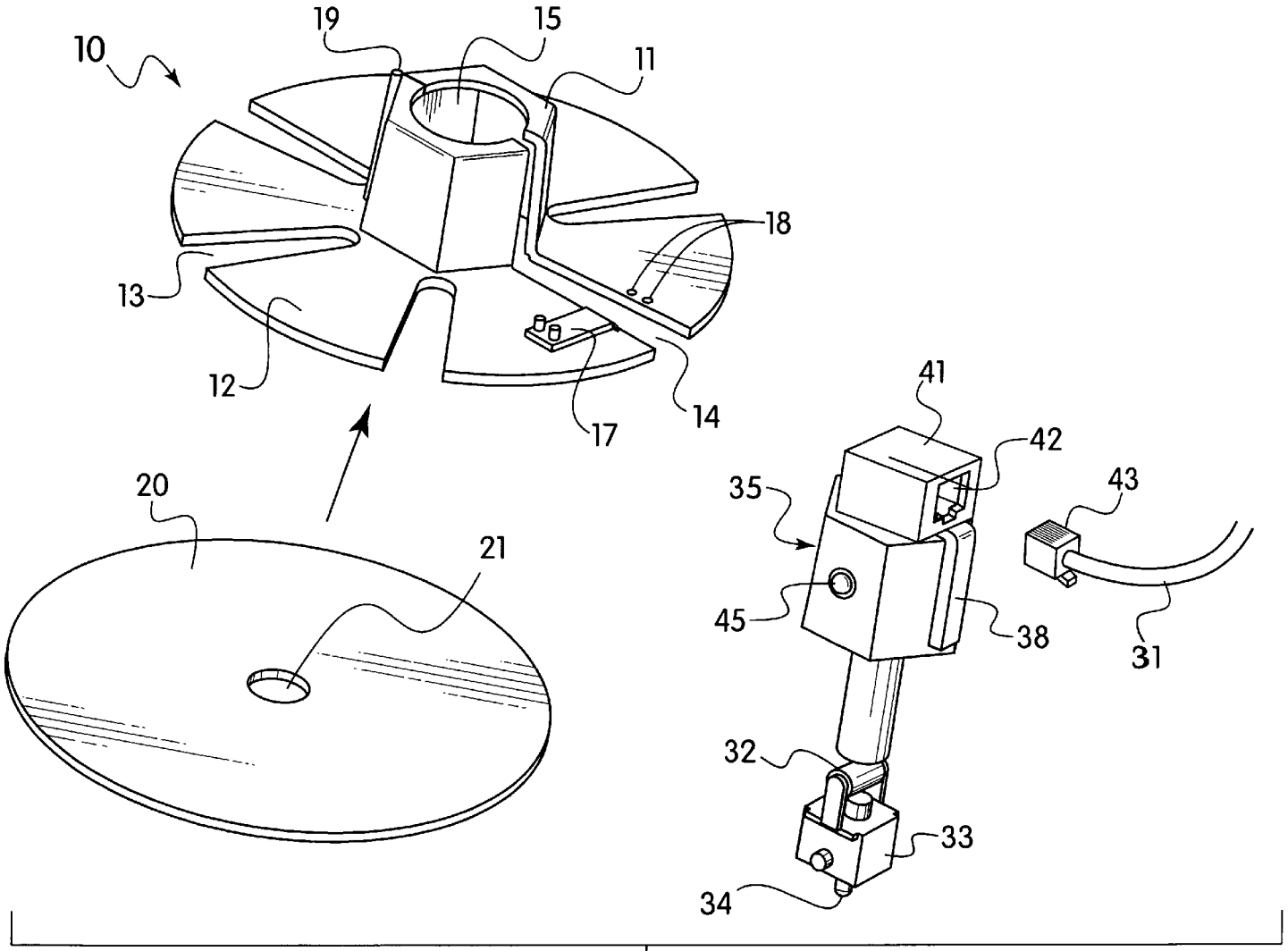
FIG. 6 shows an exploded view of an alternative embodiment of the security anchoring system according to the invention.

An alternative embodiment of the invention is shown in FIG. 6. Here, wire 30 encased in coating 31 is connected to a plug 43, and enclosure 35 is connected to a socket element 41 having a receiving aperture 42. Plug 43 and socket 41 are similar to a telephone jack connection, and electrically connect wire 30 to switch 33 and diode 32.

In this embodiment, anchor 10 has a hinge 19 along one side, and a clasp 17 which locks into holes 18 on an opposite side.

This allows anchor 10 to be opened wide to fit around enclosure 35 to attach anchor 10 to the system. Clasp 17 then closes anchor 10 once it is in proper position. Other methods of closing anchor 10 could also be used.

Accordingly, while only a few embodiments of the present invention have been shown and described, it is obvious that many changes and modifications may be made thereunto without departing from the spirit and scope of the invention.

What is claimed is:

1. A security anchoring and electronic sensing system for connection to a monitoring system having an alarm for preventing theft of an article, comprising:

a security anchor having an aperture therethrough, said anchor having a top surface and a bottom surface;

an adhesive layer attached to the bottom surface for adhering the anchor to the article;

a security wire having an end threaded through the aperture in the anchor;

means for maintaining the security wire in the aperture, comprising:

(a) an upwardly extending wall surrounding the aperture on the anchor, said wall having a slit along one side, said slit extending out to the edge of the anchor to allow the wire to be inserted in the aperture through the slit;

(b) an enclosure surrounding a switch and a diode, said enclosure having lower portion extending through the aperture and disposed within the wall, and an upper bifurcated portion extending beyond the wall; and (c) a retainer cone surrounding the wire and slidable thereon, said retainer cone having an internal circumference slightly smaller than the circumference of the bifurcated portion of the enclosure, such that sliding the retainer cone over the enclosure squeezes the enclosure inward and holds the wire within the anchor;

the diode connected to the security wire; and the switch coupled to the security wire near the diode, said switch closing when said anchor is adhered to the article and opening when said anchor is removed from the article, wherein opening the switch triggers the alarm.

2. The security anchoring system according to claim 1, wherein the anchor further comprises:

a plurality of circumferential wing slots surrounding the aperture to divide the anchor into a corresponding plurality of wings, each wing being defined between an adjacent pair of wing slots, one wing slot communicating with the aperture; and a hinge area for each wing located between the adjacent pair of wing slots to allow one wing to flex independently of another wing.

3. The security system according to claim 1, wherein the wire is coated with a flexible sheath.

4. The security anchoring system according to claim 1, wherein the lower portion of the enclosure has a longitudinally extending protrusion that fits within the slit in the wall.

5. The security anchoring system according to claim 1, wherein the aperture and wall are hexagonal in shape.

6. The security anchoring system according to claim 1, wherein the adhesive has an aperture extending therethrough and further comprising a ring-shaped ledge mounted on a bottom end of the enclosure, said ring shaped ledge extending partially into the aperture in the adhesive.

7. The security anchoring system according to claim 2, wherein there are six wings.

8. The security anchoring system according to claim 1, wherein the switch has a plunger that is depressed when the anchor is adhered to the article, and wherein release of the plunger triggers the alarm.

9. The security anchoring system according to claim 1, further comprising a bi-color LED connected to the switch, said LED glowing one color when the switch is closed and another color when the switch is opened.

10. The security anchoring system according to claim 1, further comprising a plug connected to the security wire and a socket connected to the switch and diode, wherein the plug inserts into the socket and electrically connects the security wire to the switch and diode.

11. A security anchoring and electronic sensing system for connection to a monitoring system having an alarm for preventing theft of an article, comprising:

a security anchor having an aperture therethrough, said anchor having a top surface and a bottom surface, and having a hinge along one side and a slit along an opposite side, and further comprising a latching mechanism along the slits;

an adhesive layer attached to the bottom surface for adhering the anchor to the article;

a security wire having an end threaded through the aperture in the anchor;

means for maintaining the security wire in the aperture a diode connected to the security wire; and a switch coupled to the security wire near the diode, said switch closing when said anchor is adhered to the article and opening when said anchor is removed from the article, wherein the anchor opens along the hinge to mount the anchor around the switch and diode, and wherein the anchor is closed thereafter via the latching mechanism, and wherein opening the switch triggers the alarm.

* * * * *